United States Patent [19]

Iantorno

[11] 4,190,308

[45] Feb. 26, 1980

[54] FEMALE ELECTRICAL CONNECTOR

[75] Inventor: James Iantorno, Mamaroneck, N.Y.

[73] Assignee: Sealectro Corporation, Mamaroneck, N.Y.

[21] Appl. No.: 955,407

[22] Filed: Oct. 27, 1978

[51] Int. Cl.[2] ..... H01R 31/08

[52] U.S. Cl. ..... 339/19

[58] Field of Search ..... 339/19, 222

[56] References Cited

FOREIGN PATENT DOCUMENTS 1245234 9/1971 United Kingdom ..... 339/19

*Primary Examiner*—Neil Abrams

*Attorney, Agent, or Firm*—Anthony J. Casella

[57] ABSTRACT

An electrical connector for electrically connecting a pair of spaced apart, substantially parallel, electrically conductive pin members comprises a hollow housing having opposed, spaced apart cover members and a central hub portion disposed between the cover members. The connector further includes a resilient, electrically conductive contact member which is disposed around the hub portion in a loose fit relationship. The contact member has a pair of opposed edges which are disposed parallel to the mounting direction of the connector, the opposed edges being spaced apart a distance greater than the distance between the spaced apart pin members. During mounting and dismounting of the connector from the pins, the housing hub portion effects an elongation of the contact member such that the contact member has a longitudinal axis parallel to that of the pins.

18 Claims, 17 Drawing Figures

FEMALE ELECTRICAL CONNECTOR

BACKGROUND OF THE INVENTION

The subject invention relates to electrical connectors or shorting jacks used in switching, connecting, or programming electronic circuitry. Typically, the circuitry is contained on a printed circuit board, and the outputs of the circuitry are connected to electrically conductive pin members which extend perpendicular to the surface of the printed circuit board. In accordance with a particular application, it may be desirable to electrically connect a pair of outputs on a printed circuit board. Known devices for effecting this electrical connection typically comprise female electrical connectors or shorting jacks. Generally, the jacks consist of an electrically nonconductive housing which encases a generally U-shaped conductor, the leg portions of the U-shaped conductor being female sockets or receptacles for receiving the pair of output pins. The base of the U-shaped conductor effects the electrical connection between the two printed circuit board pins. The conductive receptacles of the shorting jack usually include internal spring fingers so as to effect a spring retention of the pin members once inserted therein. It has been found, that these known shorting jacks have several shortcomings. For example, the pressure required to overcome the spring finger tension within the shorting jack during insertion and withdrawal of the jack tends to damage both the printed circuit board pins and the jack itself after a period of use. There are devices on the market that tend to effect a "zero insertion force" by freely receiving mating components without contact pressure, but typically, these devices are costly to manufacture and are somewhat complex in structure in that they require mechanisms, cams, or actuators that must be manually activated to apply the necessary contact pressure to retain the pin once it has been engaged in the device. Another shortcoming of known devices is that the female receptacles in the devices for receiving the circuit board pins must generally be plated with a precious metal, and because of the relatively extensive area to be plated, manufacturing costs tend to be undesirably high.

Accordingly, it is an object of the subject invention to provide a new and improved shorting jack which is simple in construction, and which minimizes the necessary metallic area to be plated.

It is another object of the subject invention to provide a shorting jack having the above characteristics which minimizes the contact pressure required in engaging the mating components without the need for separate mechanisms such as cams, or actuators.

SUMMARY OF THE INVENTION

In accordance with the above-recited objectives, the subject invention provides an electrical connector for electrically connecting a pair of spaced apart, substantially parallel electrically conductive pin members and comprises a hollow housing having opposed, spaced apart cover members and a central hub portion disposed between the cover members. Preferably, the housing is formed from an electrically nonconductive material. The connector of the subject invention further comprises a resilient, electrically conductive contact member which is disposed around the hub portion of the housing in a loose fit relationship. The contact member has a pair of opposed edges for mating with the circuit board pins, these opposed edges of the contact member being spaced apart a distance greater than the distance between the spaced apart pin members. As the connector is mounted onto the pins, each pin exerts an opposed inwardly directed force on the opposed edges of the contact. In addition, the hub portion of the housing acts on the lower inner surface of the contact with a downward force. The combined forces of the housing and the pins along with the flexibility of the contact effect an elongation of the contact. The elongation of the contact reduces the force required to push the connector over the pins. When the connector is fully mounted onto the pins the hub portion of the connector housing ceases its downward force on the contact. Because of the removal of this downward force, and the resilience of the contact, the contact tends to revert to its original configuration to effect a secure interference fit and electrical connection between the pins and the contact member. In one embodiment of the subject invention, the opposed cover members are generally circular in configuration such that the space between them defines an annular groove for receiving the printed circuit board pin members. In such an arrangement, the orientation of the connector to the pin members is irrelevant in that the pin members can be inserted at any position of the annular groove of the housing. In this embodiment, the hub portion of the housing may be generally cylindrical in configuration and the contact member is generally annular in configuration having a diameter greater than the linear space between the electrically conductive pin members of the printed circuit board to be connected. The contact member may also be generally diamond shaped in configuration in which the opposed edges thereof for making a contact with the pin members of the printed circuit board comprise the pair of opposed corners of the contact parallel to the direction of insertion. In another embodiment of the subject invention, the housing is substantially a hollow paralleopiped in configuration having opposed front and back walls and opposed side walls. Each of the front and back walls includes a generally rectangular aperture which define a through aperture through the housing for receiving the conductive pin members of the printed circuit board either through the front wall or the back wall of the housing. The top member has a substantially square aperture, the length of each side of the square aperture being less than the distance between the opposed edges of the contact member. The edges of the top cover member which form the periphery of the square aperture disposed thereon are preferably inwardly chamfered. In accordance with the subject invention, instead of having a substantially square shaped aperture disposed on the top cover member there may be substituted therefor an aperture which defines a plurality of edge portions in the top cover member, the edge portions comprising alternating straight edge portions and arcuate edge portions. In a further embodiment of the subject invention, the housing of the subject electrical connector is substantially a parallelopiped in configuration having four upstanding side walls, each of the side walls including a pair of substantially rectangular apertures, the apertures of one side wall being aligned with the apertures of its respective opposing side wall so as to define two pairs of through slots in the housing for receiving the conductive pin members of a printed circuit board. The spacing between the slots in each side wall being greater than the distance between the pin members to be connected.

DETAILED DESCRIPTION OF THE PREFERRED EMBODIMENTS

Figure 1:
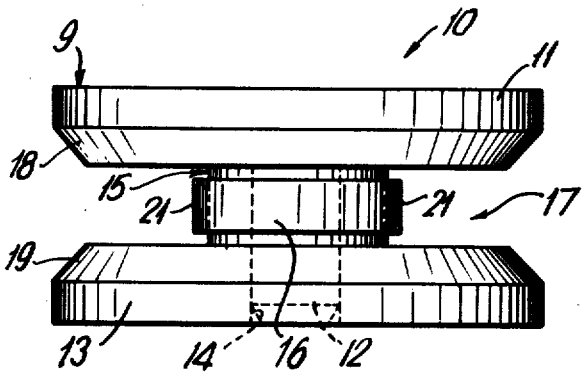
FIG. 1 is an elevational view of the first embodiment of the connector of the subject invention.
Figure 2:
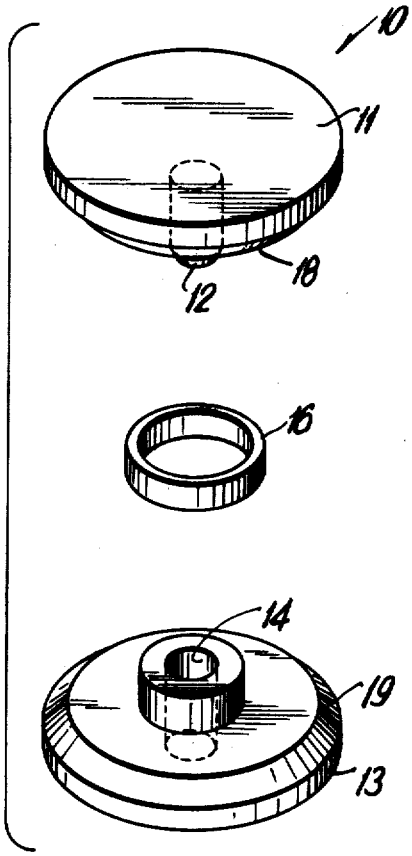
FIG. 2 is an exploded perspective view of a first embodiment of the connector of the subject invention.

Referring to FIGS. 1 and 2, the first embodiment of the connector of the subject invention is illustrated, the connector being designated by reference numeral 10. As indicated in said figures, the subject connector 10 comprises a generally spool-shaped housing 9 having opposed, spaced apart, substantially parallel cover members 11 and 13, respectively, and a central hub portion 15 disposed between cover members 11 and 13. Typically, housing 9 is formed from an electrically nonconductive material such as plastic, and may be molded or machined. Preferably, top and bottom cover members 11 and 13 are generally circular in configuration such that the space between said cover members defines an annular groove portion 17 for receiving a pair of electrically conductive pin members which are typically connected to a pair of outputs on a printed circuit board. It will be understood, however, that cover members 11 and 13 may have other than a circular configuration. The subject connector 10 further comprises a resilient, electrically conductive contact member 16 which is disposed around housing hub portion 15 in a loose fit relationship, the contact having opposed mating edges 21. The reason for the loose fit relationship will be described in detail below. As illustrated in FIG. 2, the subject connector 10 may typically be of a three part construction, including separate top and bottom portions 11 and 13, and contact 16. More particularly, the connector 10 may be constructed so as to include individually molded members 11 and 13, top member 11 having a centrally disposed peg portion 12 extending from the bottom portion thereof, and bottom member 13 having a centrally disposed well portion 14. Preferably, well 14 has a diameter slightly greater than that of peg 12, but less than that of contact member 16. In constructing the connector, peg portion 12 of top cover member 11 snugly fits into well portion 14 of the bottom cover to form hub 15. As illustrated in the figures, hub 15 is generally cylindrical in configuration, and contact 16 may be generally annular in configuration having a diameter greater than the spacing between the conductive pins to be connected, and also sufficiently greater than that of hub 15 so as to provide the loose fit relationship indicated above. Preferably, the interior portion of top and bottom cover members 18 and 19, respectively, are inwardly chamfered so as to facilitate the entry of the conductive pins in annular groove 17.

Figure 3A:
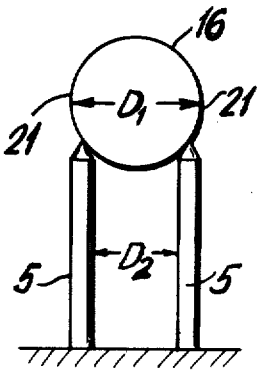
FIGS. 3A, 3B, 3C, and 3D are schematic views illustrating the effects of the forces of insertion on the contact member of the connector of the subject invention.
Figure 3B:
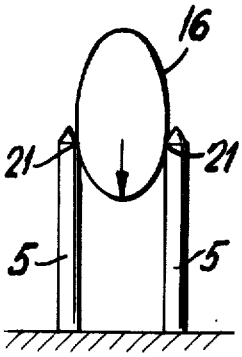
Figure 3C:
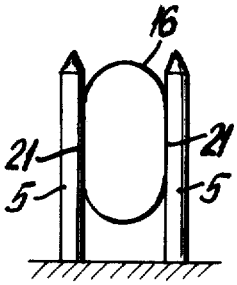
Figure 3D:
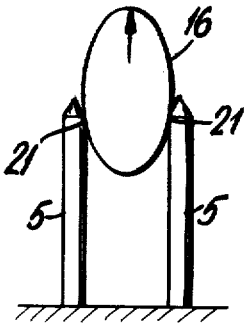
Figure 4A:
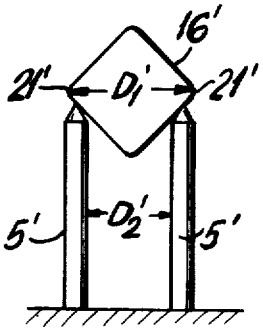
FIGS. 4A, 4B, 4C, and 4D are schematic views illustrating the effects of the forces of insertion on an alternate embodiment of the contact member of the subject invention.
Figure 4B:
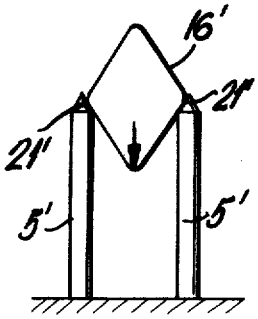
Figure 4C:
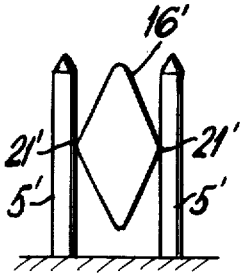
Figure 4D:
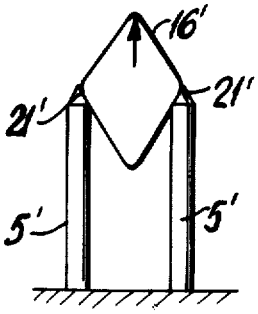

In order to electrically connect a pair of printed circuit board pins, the connector 10 is mounted on the pins such that the pins are received within annular groove 17, each pin being disposed adjacent an opposed edge 21 of the contact. Referring now to FIGS. 3A, 3B, 3C, and 3D, there is schematically illustrated the effects on contact member 16 as the subject connector is mounted onto and withdrawn from a pair of printed circuit board pins 5. Turning first to FIG. 3A, contact 16 is shown prior to the mounting of the subject connector onto a pair of printed circuit board pins 5. As shown in FIG. 3A, the diameter $D_1$ of contact member 16 is greater than the spacing between contacts 5, i.e., $D_2$. Referring to FIG. 3B, it will be noted that upon initial mounting of connector onto pins 5, the pins make contact with opposed edges 21 of the contact 16. Because the spacing of the pins ($D_2$) is less than that between opposed edges 21 ($D_1$) a resistance to the continued pushing of connector onto the pins is exerted. This resistance along with the loose fit between the contact and connector hub 15 cause hub 15 to pull downwardly on the inner surface of the leading portion of contact 16 (see arrow in FIG. 3B). This downward force of hub 15 causes the resistance forces exerted by each pin 5 to be directed upwardly and towards its opposed pin. As a result of the combination of the downward housing force and the opposed inwardly directed resistance pin forces, along with the flexibility of the contact 16, the contact 16 is elongated such that it has a longitudinal axis parallel to that of the pins 5. The elongation of the contact 16 reduces the force required to fully push the connector onto the pins. Referring to FIGS. 3C, when the connector is fully mounted, i.e. when it is no longer being pushed over the pins 5, the downwardly pulling force of housing hub 15 on the contact ceases. Because of the removal of this downward force, and the resilience of the contact member, the contact 16 tends to revert to its original configuration thus effecting a very snug interference fit and electrical connection between the contact 16 and pins 5. Referring to FIG. 3D, upon withdrawal of the subject connector from pins 5, the pins exert a resistance force on opposed edges 21 of contact 16. In addition, as illustrated in FIG. 3D, housing hub 15 exerts an upward pulling force on the leading portion, i.e. the top inner portion of contact 16. Because of the loose fit relationship between hub 15 and contact 16, as well as the flexibility of contact 16, an elongation of contact 16 is effected, again resulting in a reducing of the force required to remove the connector from pins 5. As indicated above, the contact member of the subject connector may also be generally diamond shaped configuration. As illustrated in FIGS. 4A, 4B, 4C, and 4D, the diamond shaped contact member 16' includes a pair of opposed edges 21' which are generally parallel to the direction of mounting. The spacing between opposed edges 21', i.e. $D_1'$, is greater than the spacing between pin member 5' ($D_2'$) and also greater than the diameter of hub 15' so as to provide a loose fit relationship. Thus, as with annular shaped contact member 16, upon initial mounting of diamond shaped contact member 16', pin member 5' touch opposed edges 21', and exert a force thereon resisting further pushing of the connector onto the pins. This resistance, along with the loose fit between contact 16' and housing hub 15' cause hub 15' to pull downwardly on the inner bottom surface of contact 16' (see arrow in FIG. 4B). This downward force causes the resistance forces exerted by each pin 5' to be directed upwardly and towards its opposed pin. As a result, the combined downward force of housing hub 15' and the inwardly directed pin resistance, along with the flexibility of the contact, effect an elongation of the contact such that it has a longitudinal axis parallel to that of pins 5'. This elongation reduces the force required to overcome the resistance of pins 5' and to fully push the connector onto the pins. When the connector is fully mounted (see FIG. 4C) the downward force of housing hub 15' on contact 16' ceases and the contact, because of its resilience tends to revert to its original configuration, effecting a very snug interference fit between the contact 16' and pins 5'. Upon withdrawal of the connector from pins 5', housing hub 15' exerts an upward force on the inner upper portion of contact 16' (see arrow in FIG. 4D) so as to again elongate the contact and reduce the force required to overcome the resistance of pin 5', thus facilitating the dismounting of the connector. It will be understood that in accordance with the subject invention, the contact member of the subject connector may have a configuration other than annular or diamond shaped, it merely being necessary that the contact may be loosely fitted around the hub portion of the connector and have the dimensions and resilience described above such that the housing hub may effect the necessary elongation of the contact during connector mounting and dismounting.

Figure 5:
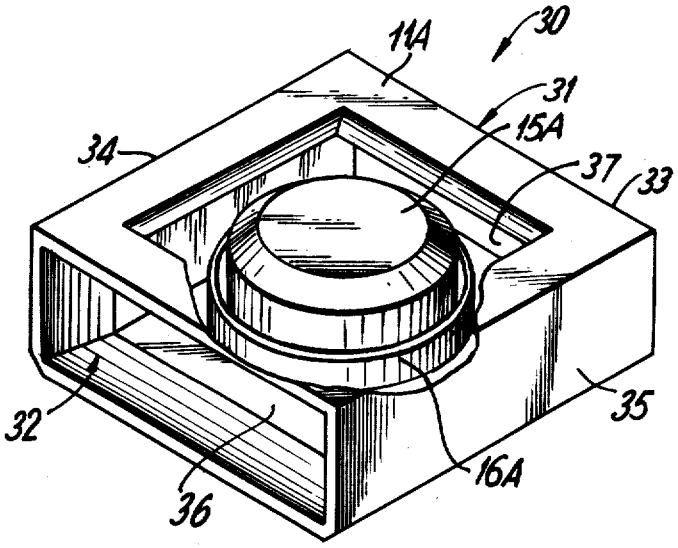
FIG. 5 is a perspective view, broken away in part, of a second embodiment of the connector of the subject invention.
Figure 6:
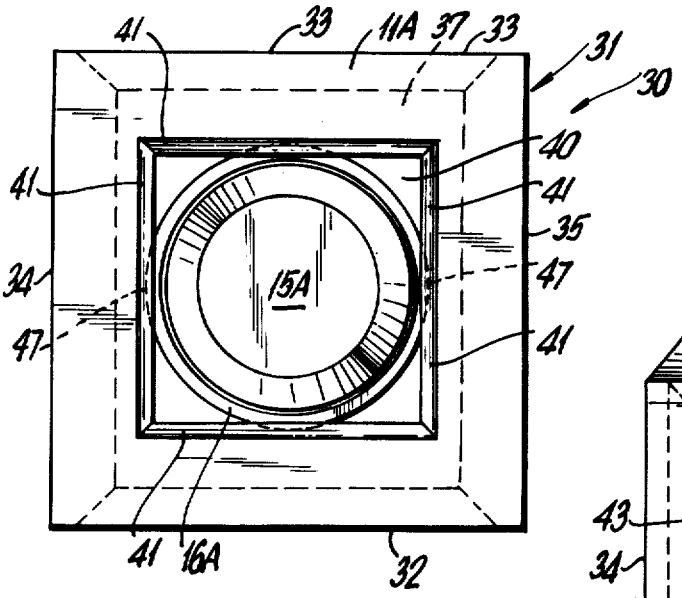
FIG. 6 is a plan view of the second embodiment of the connector of the subject invention.
Figure 7:
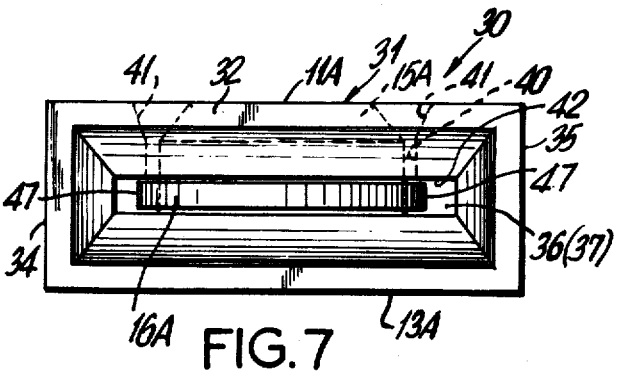
FIG. 7 is a front elevational view of the second embodiment of the connector of the subject invention.

Turning now to FIGS. 5, 6, and 7, there is illustrated a second embodiment of the connector of the subject invention, said connector being designated generally by reference numeral 30. As illustrated in said figures, connector 30 includes a housing 31 which is generally a parallelopiped in configuration having a top wall 11A, bottom wall 13A, opposed front and back walls 32 and 33, and opposed side walls 34 and 35. Each of the front and back walls include a generally rectangular aperture 36 and 37 respectively, said apertures defining a through aperture through the housing 31 for receiving the printed circuit board pin members to be connected either through the front wall or the back wall. The subject connector 30 also includes a central hub portion 15A which is disposed between top and bottom walls 11A and 13A. The subject connector further includes a resilient contact member 16A which is disposed around hub portion 15A in loose fit relationship and has opposed mating edges 47 which are spaced a distance greater than that between the printed circuit board pins to be connected. As indicated in FIGS. 5–7, contact member 16A may be annular in configuration but as with contact 16 of the first embodiment of the subject invention, said contact member 16A may take on any configuration which permits housing hub 15A to effect the necessary elongation thereof during mounting and dismounting of the subject connector on the printed circuit board pin members. The subject connector 30 further includes a substantially square aperture 40 disposed on top cover portion 11A. The edges 41 which form the periphery of aperture 40 are preferably inwardly chamfered such that in constructing the subject connector the contact member 16A, which has a diameter greater than the length of aperture 40, may be pinched at the edges thereof which come in contact with edges 41 of the housing so as to reduce in size and enter the housing without the need to specifically orient the contact. Referring to FIG. 7, once the contact 16A has reached the bottom surface 42 of top cover member 11A it is free to expand to its normal position such that it is retained within the housing.

Figure 9:
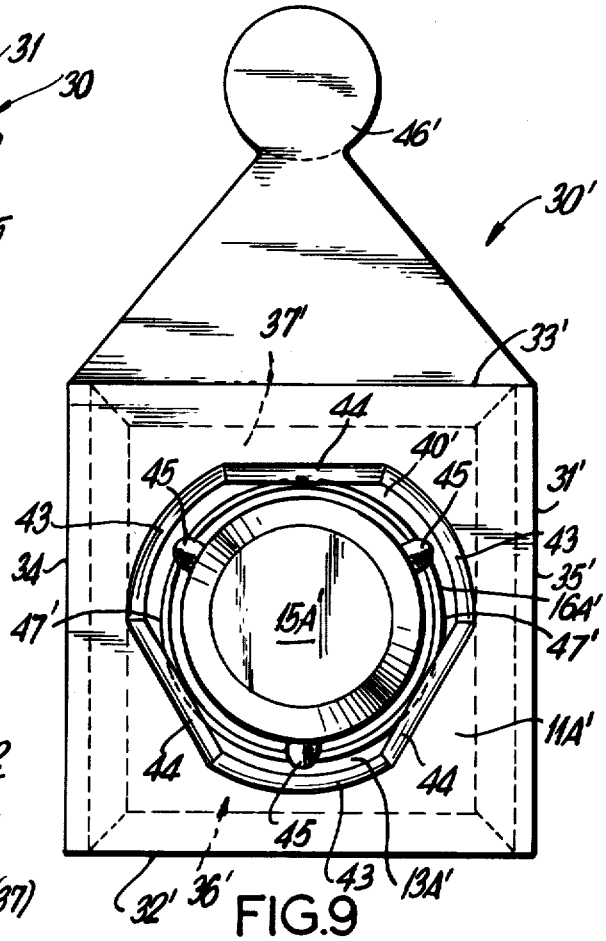
FIG. 9 is a plan view of the third embodiment of the connector of the subject invention.
Figure 8:
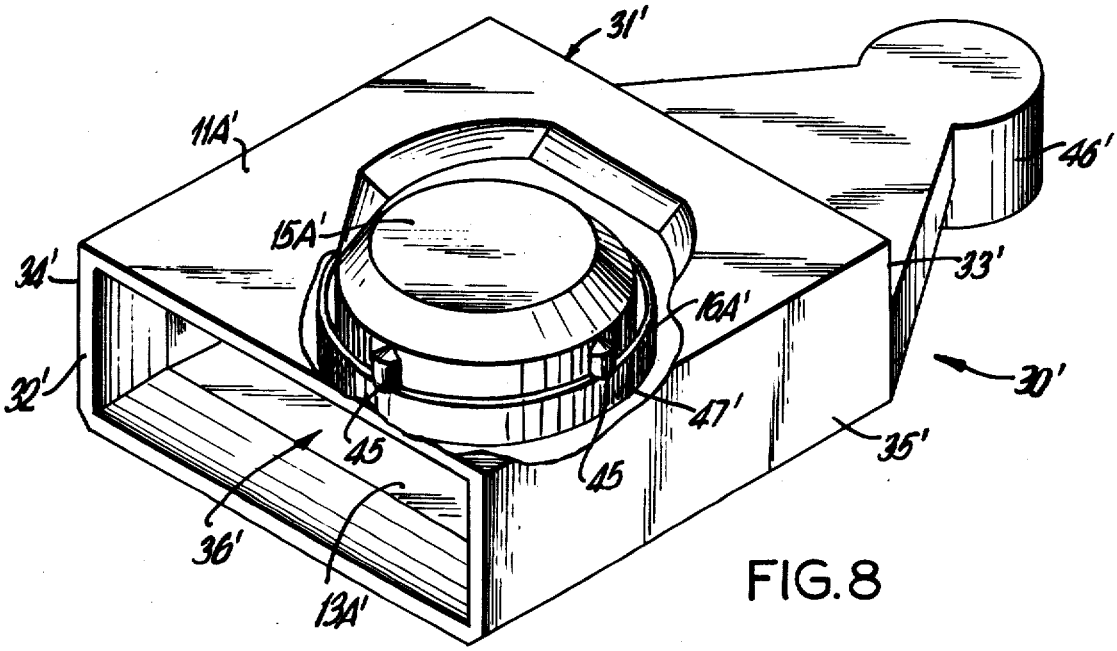
FIG. 8 is a perspective view, broken away in part, of a third embodiment of the connector of the subject invention.

Referring to FIGS. 8 and 9, there is illustrated a third embodiment of the connector of the subject invention. As illustrated in said figures, connector 30' is similar in construction to connector 30 illustrated in FIGS. 5–7. More particularly, connector 30' comprises a housing 31' which is generally a parallelopiped in configuration having a top wall 11A', a bottom wall 13A', opposed front and back walls 32' and 33', and opposed side walls 34' and 35'. Front and back walls 32' and 33' each include a generally rectangular aperture 36' and 37' which define a through aperture in the housing for receiving printed circuit board pins through either the front or back wall. Connector 30' also includes a central hub portion 15A' which is disposed between top wall 11A' and bottom wall 13A', and a resilient contact member 16A' disposed around hub 15A' in loose fit relationship. Connector 30' further includes an aperture 40' disposed on top wall 11A', aperture 40' being defined by a plurality of alternating straight edges 44 and arcuate edges 43, each of said edges being inwardly chamfered. The particular configuration of aperture 40', along with the provision of a plurality of retainer members 45, which extend from hub 15A' and are disposed above contact 16A' minimizes the possibility that contact 16A' might be ejected through aperture 40' during the mounting or dismounting of the connector from a pair of printed circuit board pins.

Regarding both connectors 30 and 30', it will be noted that their respective housings 31 and 31' may be of one piece construction and molded from a plastic material. It will also be noted that because both connectors 30 and 30' include closed side wall portions 34 and 35, and 34' and 35' respectively, flexible square or round leads are prevented from moving away from contacts 16A and 16A'. Referring to FIG. 9, it will be noted that connector 30' may include an integral handle member 46' for facilitating mounting and dismounting of the connector. It will be understood that a similar handle member may be included in all the embodiments of the subject invention.

Figure 10:
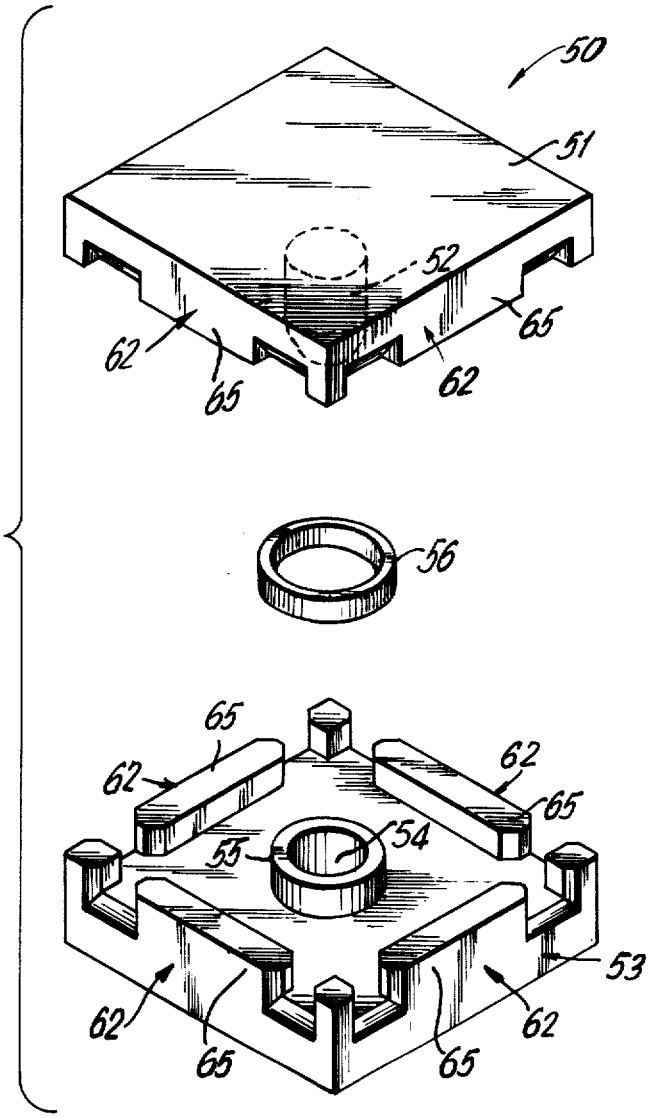
FIG. 10 is an exploded perspective view of the fourth embodiment of the connector of the subject invention.
Figure 11:
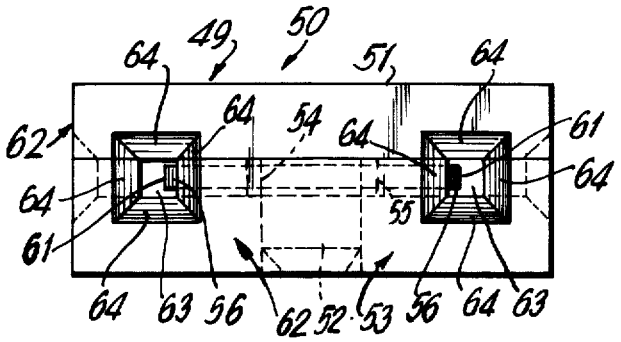
FIG. 11 is a front elevational view of the fourth embodiment of the connector of the subject invention.

Referring now to FIGS. 10 and 11, there is illustrated a fourth embodiment of the connector of the subject invention, the connector being designated by reference numeral 50. As illustrated in the figures, connector 50 includes an electrically nonconductive housing 49 which is generally a parallelopiped in configuration having a top wall 51, a bottom wall 53, and four upstanding side walls 62. Housing 49 further includes a central hub member 55 which is disposed between top and bottom walls 51 and 53. As further illustrated in the figures, housing 49 may be of a two part construction comprising a separately molded top member 51 having a central peg portion 52 disposed on the undersurface thereof, and a separately molded bottom portion 53 having a central well portion 54 disposed on the upper surface thereof for receiving peg portion 52 and forming central hub member 55.

The subject connector 50 further includes a resilient electrically conductive contact member 56 which is disposed around hub 55 in loose fit relationship. Contact 56 includes a pair of opposed mating surfaces 61, the spacing between said mating surfaces being greater than the distance between the printed circuit board pins to be connected. As with the previously described embodiments of the subject invention, while contact member 56 is illustrated in the figures as being annular in configuration, said contact member may be diamond shaped in configuration or any other configuration that permits it to be elongated in accordance with the subject invention during mounting and dismounting of the connector. Further referring to FIGS. 10 and 11, each of the side walls 62 of housing 49 includes a pair of substantially rectangular apertures 63, the apertures of one side wall being aligned with the apertures of its opposing side wall such that there are provided two pairs of through slots in the housing for receiving a pair of conductive pins from a printed circuit board in any of the four side walls. It will be noted that the side wall edges 64 which define the periphery of each aperture 63 are inwardly chamfered so as to facilitate the entry of a printed circuit board pin into the respective aperture and prevent interference with full insertion of the pin. It will be further noted that in operation side wall portions 65, which are disposed between apertures 63 prevent flexible square or round leads from moving away from contact 56.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. An electrical connector for electrically connecting a pair of spaced apart, substantially parallel, electrically conductive pin members comprising:

a housing formed of an electrically nonconductive material and having a pair of opposed, spaced apart cover members and a central hub portion disposed between the cover members; and a continuous, electrically conductive contact member which is resilient and is disposed around said hub portion in a loose fit relationship, said contact member having a pair of opposed edges disposed parallel to the mounting direction of the connector, said opposed edges being spaced apart a distance greater than the distance between said spaced apart pin members such that when the connector is pushed over said pin members, the pin members resist said pushing action, and the hub portion of the connector housing exerts a force on the lead portion of said contact member to effect an elongation of said contact member thus reducing the pushing force required to overcome the resistance of said pin member and such that when said pushing action is stopped, said hub portion of the connector housing ceases to exert said force on the contact, and the contact tends to revert to its original configuration to effect a secure interference fit and electrical connection between the pins and contact member.

2. An electrical connector as recited in claim 1 in which each of said opposed cover members is generally circular in configuration such that the space between said cover members comprises an annular groove for receiving said pin members.

3. An electrical connector as recited in claim 2 in which said hub portion is generally cylindrical in configuration and said contact member is generally annular in configuration having a diameter greater than the linear spacing between the electrically conductive pin members.

4. An electrical connector as recited in claim 2 in which said contact member is generally diamond shaped in configuration in which the opposed edges of the contact member for making contact with the pin members comprise the pair of opposed corners disposed parallel to the mounting direction of the connector.

5. An electrical connector as recited in claim 1 in which said housing is generally a parallelopiped in configuration having two pairs of opposed wall members, at least one of said wall members including a generally rectangular aperture, said aperture having a length greater than the distance between the opposed edges of said contact, said aperture defining an aperture through the housing for receiving the pin members through said wall members.

6. An electrical connector as recited in claim 5 in which one of said cover members includes a substantially square aperture, the length of each side of said square aperture being less than the distance between the opposed edges of said contact, the edges of said cover member forming the periphery of said square aperture being inwardly chamfered.

7. An electrical connector as recited in claim 5 in which one of said cover members includes an aperture defining a plurality of edge portions in said cover member, said edge portions comprising alternating straight edge portions and arcuate edge portions.

8. An electrical connector as recited in claim 7 in which the aperture in said cover member is defined by three straight edge portions and three arcuate edge portions, each straight edge portion being disposed between two arcuate edge portions.

9. An electrical connector as recited in claim 5 which further includes a plurality of spaced apart retaining members extending from said hub member disposed above said contact member.

10. An electrical connector as recited in claim 5 in which said housing further includes a handle member extending from the back wall of the housing.

11. An electrical connector as recited in claim 1 in which said housing is substantially a parallelopiped in configuration having four upstanding side walls, at least one of said side walls including a pair of substantially rectangular apertures, said apertures defining at least one pair of slots in said housing for receiving said conductive pin members, the spacing between said apertures in said side wall being greater than the distance between the conductive pin members to be connected.

12. An electrical connector as recited in claim 11 in which the housing includes a plurality of edge portions defining the periphery of said side wall apertures, each of said edge portions being inwardly chamfered.

13. An electrical connector for electrically connecting a pair of spaced apart, substantially parallel, electrically conductive pin members comprising:

a generally spool shaped housing having a pair of opposed, spaced apart generally circular cover members and a central, generally cylindrical hub portion disposed between the cover members, said spacing between said cover members defining an annular groove for receiving said pin members; and a resilient, electrically conductive generally annular contact member disposed around said hub portion in a loose fit relationship, said contact having a diameter greater than the spacing between said pin members, said contact member having a pair of opposed edges disposed generally parallel to the mounting direction of the connector, said opposed edges being spaced apart a distance greater than the distance between said spaced apart pin members such that when the connector is pushed over said pin members, the pin members resist said pushing action, and the hub portion of the connector housing exerts a downward force on the lead portion of said contact member to effect an elongation of said contact member thus reducing the pushing force required to overcome the resistance of said pin members and such that when said pushing action is stopped, said hub portion of the connector housing ceases to exert said downward force on the contact, and the contact tends to revert to its original configuration to effect a secure interference fit and electrical connection between the pins and contact member.

14. An electrical connector for electrically connecting a pair of spaced apart, substantially parallel, electrically conductive pin members comprising:

a substantially hollow housing generally a parallelopiped in configuration having a pair of opposed, spaced apart cover members, and four upstanding wall members, said housing further including a generally cylindrical hub portion disposed between the cover members, and a handle member extending from one of said wall members; and a resilient, electrically conductive annular contact member disposed around said hub portion in a loose fit relationship, said contact having a diameter greater than the spacing between said pin members, said contact member having a pair of opposed edges disposed parallel to the mounting direction of the connector, said opposed edges being spaced apart a distance greater than the distance between said spaced apart pin members;

each of an opposed pair of said housing wall members including a generally rectangular aperture having a length greater than the distance between said opposed edges of said contact, said apertures being aligned so as to define a through aperture through said housing such that when the connector is pushed over said pin members, the pin members resist said pushing action, and the hub portion of the connector housing exerts a downward force on the lead portion of said contact member to effect an elongation of said contact member thus reducing the pushing force required to overcome the resistance of said pin members and such that when said pushing action is stopped, said hub portion of the connector housing ceases to exert said downward force on the contact, and the contact tends to revert to its original configuration to effect a secure interference fit and electrical connection between the pins and contact member.

15. An electrical connector as recited in claim 14 which further includes a plurality of spaced apart retaining members extending from said hub portion and disposed above said contact member.

16. An electrical connector as recited in claim 14 in which one of said cover members includes an aperture defined by three arcuate edges and three straight edges, said edges being arranged in alternating relationship such that each straight edge is disposed between two arcuate edges.

17. An electrical connector as recited in claim 14 in which one of said cover members includes a generally square aperture, the length of each side of said square aperture being less than the diameter of said contact member.

18. An electrical connector for electrically connecting a pair of spaced apart, substantially parallel, electrically conductive pin members comprising:

a substantially hollow housing generally a parallelopiped in configuration having a pair of opposed, spaced apart cover members and four upstanding wall members, said housing further having a generally cylindrical hub portion disposed between the cover members, each of said wall members including a pair of generally rectangular apertures, the apertures of each respective pair of apertures being spaced a distance greater than the distance between said pin members, the apertures of each side wall being aligned with the apertures of the respective opposed side wall thus defining two pairs of through slots in the housing such that said pair of pin members may be received in any of said housing wall members; and a resilient, electrically conductive annular contact member disposed around said hub portion in a loose fit relationship, said contact having a diameter greater than the spacing between said pin members, said contact member having a pair of opposed edges disposed, generally parallel to the mounting direction of the connector, said opposed edges being spaced apart a distance greater than the distance between said spaced apart pin members such that when the connector is pushed over said pin members, the pin members resist said pushing action, and the hub portion of the connector housing exerts a downward force on the lead portion of said contact member to effect an elongation of said contact member thus reducing the pushing force required to overcome the resistance of said pin members and such that when said pushing action is stopped, said hub portion of the connector housing ceases to exert said downward force on the contact, and the contact tends to revert to its original configuration to effect a source interference fit and electrical connection between the pins and contact member.

* * * * *